US011066195B1

(12) United States Patent
Curtiss et al.

(10) Patent No.: US 11,066,195 B1
(45) Date of Patent: Jul. 20, 2021

(54) SYSTEM FOR FILLING BAGS WITH SAND

(71) Applicants: Gordon Curtiss, Cumming, GA (US); Barbra Curtiss, Cumming, GA (US)

(72) Inventors: Gordon Curtiss, Cumming, GA (US); Barbra Curtiss, Cumming, GA (US)

( * ) Notice: Subject to any disclaimer, the term of this patent is extended or adjusted under 35 U.S.C. 154(b) by 0 days.

(21) Appl. No.: 16/593,565

(22) Filed: Oct. 4, 2019

(51) Int. Cl.
*B65B 1/12* (2006.01)
*B65B 67/04* (2006.01)

(52) U.S. Cl.
CPC ..... *B65B 1/12* (2013.01); *B65B 67/04* (2013.01)

(58) Field of Classification Search
CPC .... B65B 1/04; B65B 1/10; B65B 1/12; B65B 67/04
See application file for complete search history.

(56) References Cited

U.S. PATENT DOCUMENTS 3,552,346 A * 1/1971 Garden ..... B65B 1/08 141/72
4,184,522 A * 1/1980 Waite ..... B65B 1/00 141/231
4,819,701 A * 4/1989 Thornton ..... B65B 1/04 141/231
5,802,807 A * 9/1998 Johnson ..... B65B 67/1238 141/391
5,893,260 A 4/1999 McKenna
5,901,762 A * 5/1999 Rollins ..... B65B 1/12 141/231
5,988,237 A * 11/1999 Bedsole ..... B65B 1/12 141/114
6,237,309 B1 * 5/2001 DeMarco ..... B65B 1/12 141/231
6,637,474 B2 * 10/2003 Hall ..... B65B 1/06 141/231
6,978,812 B2 * 12/2005 Summerville ..... B65B 1/06 141/114
8,100,301 B2 * 1/2012 Babiarz ..... B65B 1/12 222/196
10,287,038 B2 * 5/2019 Boutwell ..... B65B 67/02
2007/0243053 A1 * 10/2007 Babiarz ..... E02F 3/407 414/725
2012/0132316 A1 * 5/2012 Nielsen ..... B65B 9/06 141/10
2019/0031099 A1 * 1/2019 Kimura ..... E01H 5/061

* cited by examiner

*Primary Examiner* — Nicolas A Arnett
(74) *Attorney, Agent, or Firm* — Sanchelima & Associates, P.A.; Christian Sanchelima; Alexander Rodriguez

(57) ABSTRACT

A system for filling bags with sand including a motor assembly, an auger assembly, and a chute assembly is enclosed herein. The motor assembly includes a motor and a frame having wheels attached to the frame. The motor is configured to provide a user with multiple drive speeds to provide maximum maneuverability. The motor is communicably connected to the auger assembly having an auger enclosed around a body being cubic in shape. The auger assembly is configured to effortlessly and efficiently intake large amounts of sand as a user operates the motor. The sand then collected by the auger assembly is transferred to the chute assembly. The chute assembly comprises a first portion and a second portion to aid an assistant in filling bags with sand. The first portion and the second portion are directionally adjustable to further aid an assistant in collecting sand.

10 Claims, 5 Drawing Sheets

SYSTEM FOR FILLING BAGS WITH SAND

BACKGROUND OF THE INVENTION

1. Field of the Invention

The present invention relates to a system for filling bags with sand and, more particularly, to a system for filling bags with sand that includes a motor, an auger, and an adjustable chute to aid a user in quickly and efficiently fill sandbags.

2. Description of the Related Art

Several designs for a system for filling bags with sand have been designed in the past. None of them, however, include a self-propelled automatic sandbag filling device with construction similar to an auger-driven snow blower which may include multiple drive speeds, electric start, high traction tires, and a steel frame and platform. It is known that individuals have a need to fill bags with sand in the event of storm preparations and flood prevention activities. It is also known that sand can be extremely cumbersome to gather and fill into bags. Individuals often use a shovel to manually pick up sand to then fill into sand bags. This system is extremely cumbersome for individuals and exceptionally time consuming. Therefore, there is a need to provide a system for filling bags with sand that is efficient and effortless to operate.

Applicant believes that a related reference corresponds to U.S. Pat. No. 5,893,260 issued for a portable apparatus for forming and filling sandbags. The cited disclosure comprises a method and apparatus for automatically forming and filling sandbags. The apparatus has an excavator for obtaining fill material for the sandbags. However, it differs from the present invention because the U.S. Pat. No. 5,893,260 reference provides a configuration that is complicated to use and not cost efficient for individuals in need of a system to fill sand bags in the case of a natural disaster preparation activities for storms, floods, and the like. The present invention addresses this issue by providing a system for filling bags with sand including a motor assembly, an auger assembly, and a chute assembly that is provided to a user pre-assembled to aid in the accessibility for filling sandbags. As a result, a system for filling bags with sand will be more accessible to all kinds of individuals in need of sandbags in the event of a natural disaster.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a system for filling bags with sand that eliminates the need of a user having to manually shovel sand to fill bags.

It is another object of this invention to provide a system for filing sand bags that allows a user to quickly and efficiently fill bags with sand to assist individuals in storm preparation and flood prevention.

It is still another object of the present invention to provide a system for filing sand bags that includes a motor with multiple drive speeds to allow a user to efficiently maneuver through any terrain and collect sand to be stored in sandbags.

It is still another object of the present invention to create a user-friendly device that will safely and efficiently fill sandbags in a few seconds thus drastically reducing the time and effort it currently takes to fill sandbags by hand with a shovel.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
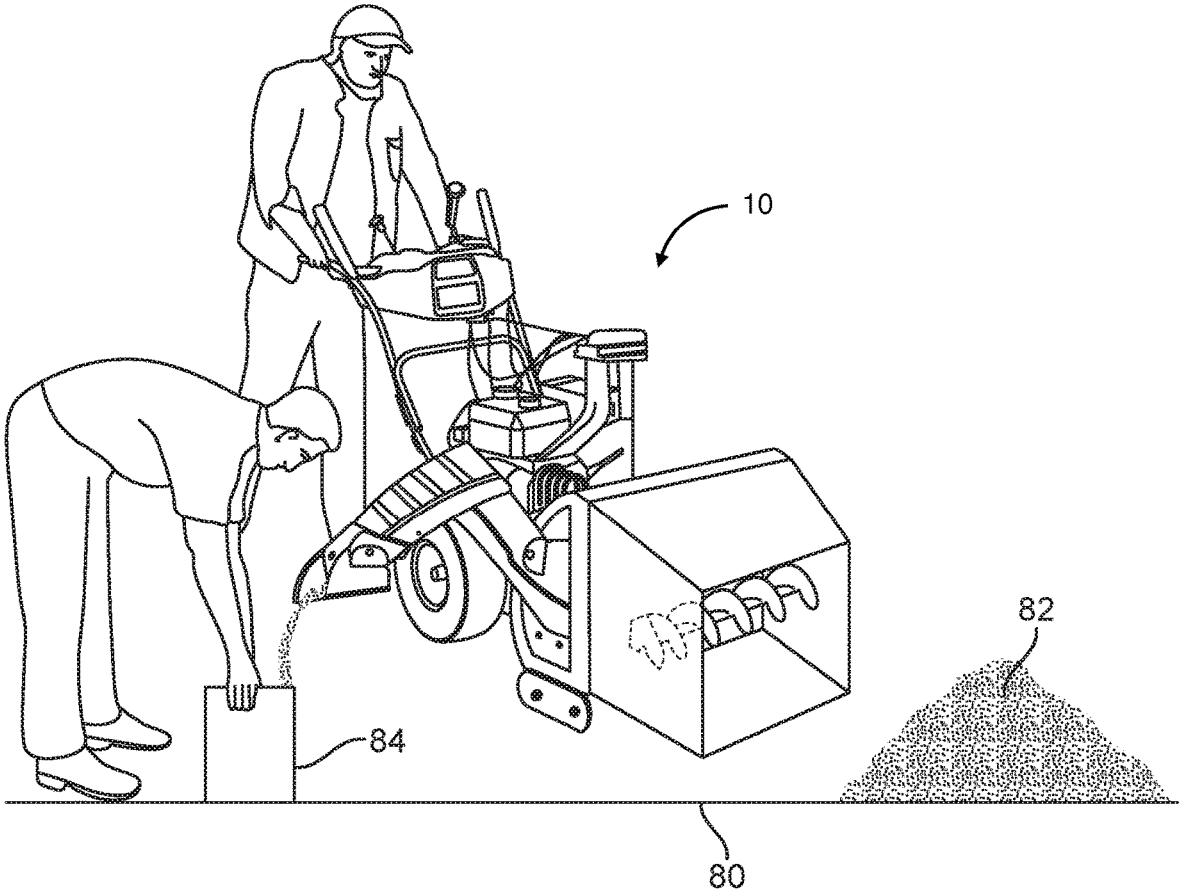
FIG. 1 shows a system for filling bags with sand 10 in use wherein users may be seen operating the system for filling bags with sand 10 in a sand environment 80.
Figure 2:
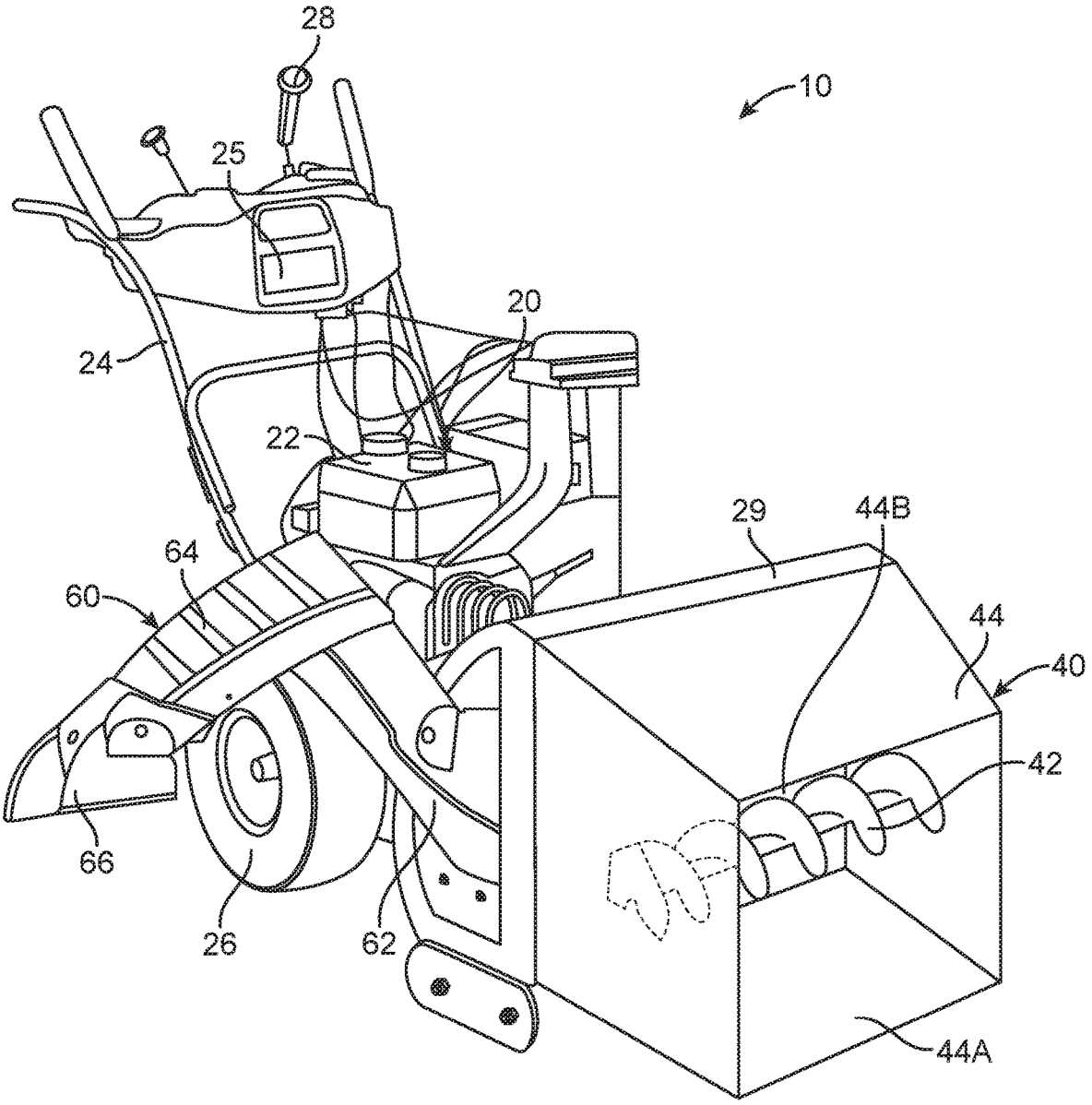
FIG. 2 represents an isometric view of a system for filling bags with sand 10 wherein motor assembly 20, auger assembly 40, and chute assembly 60 may be viewed.
Figure 3:
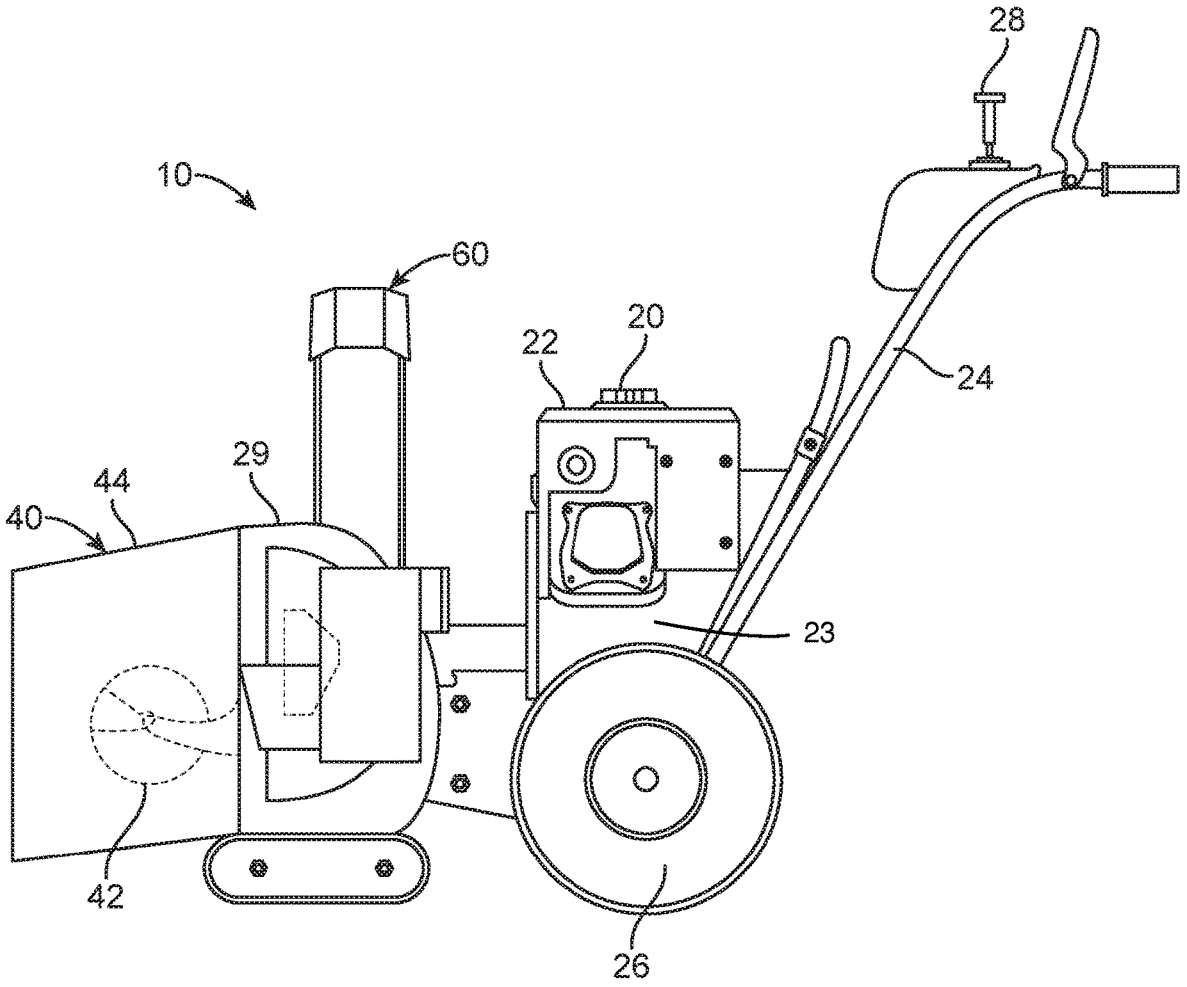
FIG. 3 illustrates a side view of a system for filling bags with sand 10 in accordance to an embodiment of the present invention.
Figure 4:
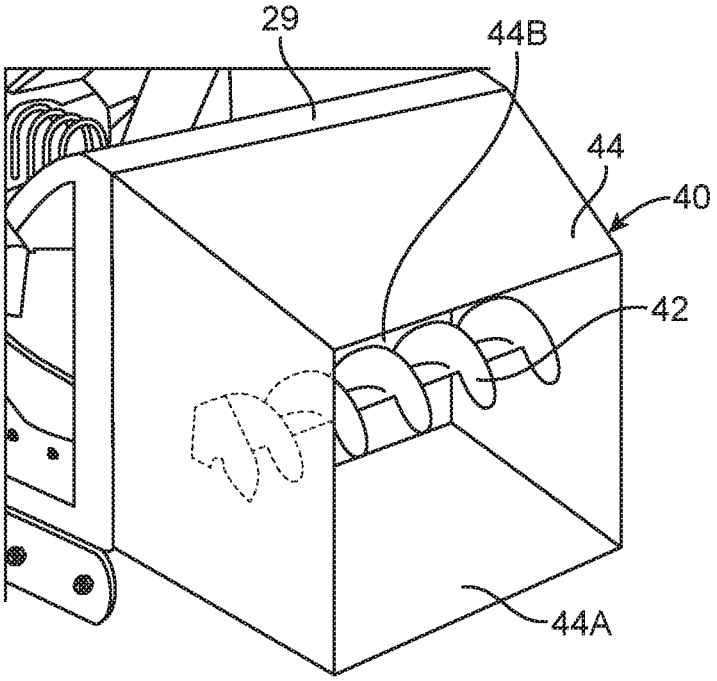
FIG. 4 represents an isometric view of auger assembly 40 in accordance to an embodiment of the present invention.
Figure 5:
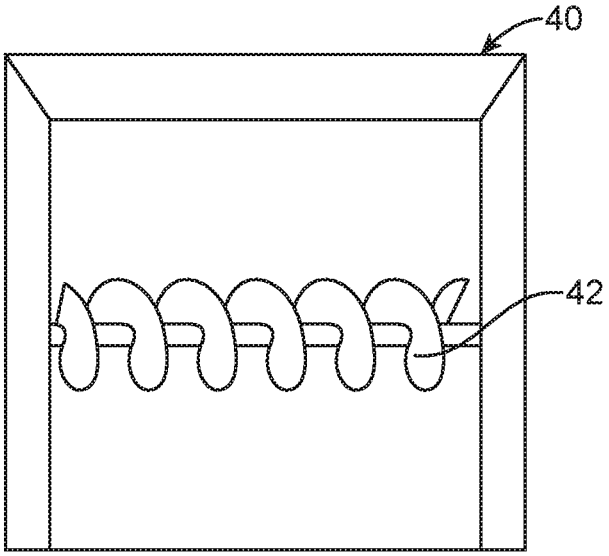
FIG. 5 shows an enlarged front view of auger assembly 40 in accordance with an embodiment of the present invention.
Figure 6:
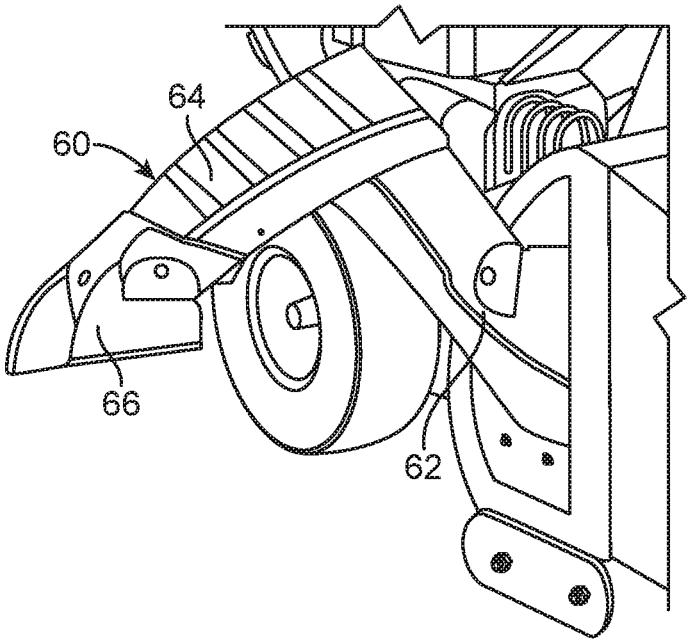
FIG. 6 illustrates an enlarged view of chute assembly 60 in accordance with an embodiment of the present invention.

Referring now to the drawings, where the present invention is generally referred to with numeral 10, it can be observed a system for filling bags with sand 10 that basically includes a motor assembly 20, an auger assembly 40, and a chute assembly 60.

Motor assembly 20 includes a motor 22, a platform 23, a steel frame 24, and wheels 26, and user controls 28. Motor 22 is securely mounted onto the top of platform 23 of steel frame 24. Furthermore, steel frame 24 includes at least two wheels 26 being mounted to steel frame 24. Additionally, steel frame 24 includes a vertical portion wherein said user controls 28 may be located. User controls 28 are located on said steel frame 24 to allow a user to control the speed at which motor 22 operates. Motor 22 is mounted to steel frame 24 using known methods in the art such as fasteners, welding, and the like. In one embodiment, a steel body 29 may be mounted to a front end of platform 23. Steel body 29 may resemble the front end of a snow blower in various embodiments. Furthermore, motor 22 is configured to allow a user to efficiently maneuver steel frame 24 in a sand environment 80. In the present embodiment steel frame 24 is made of a heavy-duty steel material. However, it should be understood that any other suitable material may be used for steel frame 24. In one embodiment, motor 22 may be a powerful 4 cycle gasoline engine, however it should be understood that any suitable motor may be used. In another embodiment of the present invention, user controls 28 include configured with an electric start system to provide a user with greater ease of operation. Wheels 26 may be of a large type to allow a user to gain optimal traction. Steel frame 24 further includes an LED headlight 25 to aid a user in operating said steel frame 24 during nighttime. In the present embodiment, a user initiates motor 22 through user controls 28. The user may then maneuver steel frame 24 having wheels 26 freely among any suitable terrain to collect sand. In a preferred embodiment, motor assembly 20 may also include a large fuel tank to provide a user with prolonged periods of use. The fuel tank may be made of a plastic or any other suitable material. In a preferred embodiment, the fuel tank is made of a steel material to provide durability and reliability.

Auger assembly 40 includes an auger 42 and a housing 44. Housing 44 may comprise of a cubic shape to be mounted to steel frame 24 through methods known in the art such as fasteners, welding, and the like. Housing 44 may be made of any suitable material configured to collect sand. Additionally, housing 44 may have a cubic shaped hollow body. Housing 44 further comprises a frontside 44A and a backside 44B. Frontside 44A of housing 44 is open to allow sand to be funneled into housing 44 and then fed into auger 42. Additionally, backside 44B is open to allow sand to then be fed to chute assembly 60. Housing 44 further includes a top end that tapers inwardly from backside 44B to frontside 44A. In one embodiment, housing 44 is mounted to a front end of steel body 29. As sand enters through frontside 44A auger 42 which is in a spinning motion, then collects the sand and moves it to backside 45B. In the present embodiment, auger 42 is mounted in a horizontal position within housing 44. Auger 42 may comprise of a spiral extending from its top vertical end to its bottom vertical end. In another embodiment of the present invention, other forms of augers may be used. It should be understood that other embodiments of the present invention may include additional augers to aid a user in more efficiently collecting sand.

Chute assembly 60 includes a first portion 62 and a second portion 64. First portion 62 may be a rectangular chute attached to the left or right side of steel body 29. The present invention depicts first portion 62 mounted to the left side of steel body 29. However, it should be understood that first portion 62 may be mounted to additional locations of steel body 29. First portion 62 may be made of any suitable material to withstand the transfer of sand for extended use. These may include materials such as metals, carbon fiber, and the like. Second portion 64 is hingedly mounted to first portion 62. Second portion 64 may be a rectangular chute adjustably connected to first portion 62. A user may then adjust second portion 64 by utilizing said hinges located on first portion 64. Second portion 64 may additionally be made of any suitable material to withstand the transfer of sand for extended use. These may include materials such as metals, carbon fiber, and the like. Chute assembly 60 further comprises chute head 66. Chute head 66 is mounted onto second portion 64 using known mechanisms in the art such as fasteners, welding, and the like. Chute head 66 may be made of any suitable material to withstand the transfer of sand for extend use. In one embodiment of the present invention, chute head 66 is adjustable, allowing a user to hingedly move chute head 66 to adjust its position. Chute head 66 is configured to output the sand captured by housing 44 into a sand bag 84. In yet another embodiment of the present invention, a user utilizes system for filling bags with sand 10 in a sand environment 80. A user then maneuvers steel frame 24 to a sand pile 82. Sand pile 82 is then inserted into housing 44 of auger assembly 40. The sand is then transported to chute assembly 60, where it travels therein first portion 62 and second portion 64. The sand then exits from chute head 66 attached to second portion 64 and into a sand bag 84, where in another user is holding the sandbag and changing it for an empty sandbag once it is full.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for filling bags with sand, comprising:

a. a motor assembly, including a steel frame and a platform, wherein said steel frame includes at least two wheels mounted to said steel frame, wherein said wheels are high traction tires, wherein a motor is mounted on top of said platform, wherein said motor is configured to rotate said wheels, wherein said frame includes a vertical portion, wherein said vertical portion includes user controls thereon, wherein said user controls are configured to provide a user with multiple drive speeds, and electric start, wherein said motor assembly includes a steel body mounted to the front end of said platform, said steel body located entirely in front of said wheels;

b. an auger assembly, including an auger and a housing, wherein said housing is a cubic shaped hollow body having an open frontside and an open backside, wherein said backside has a larger area than said frontside, wherein said housing includes a top end, wherein the top end tapers from said backside to said frontside, wherein said backside is mounted onto the said steel body of said motor assembly, wherein said steel body includes a front face which abuttingly engages with said backside of housing, wherein a shape of said backside cooperates with a shape of said front face such that said backside entirely covers said front face, wherein said auger is mounted in a horizontal position therein sidewalls of said housing, wherein, wherein said housing is receives a sand pile therein, wherein said auger is configured to be controlled by said motor where a user may control different speeds of said auger using said user controls; and c. a chute assembly, including a first portion and a second portion, wherein a proximal end of the chute assembly is entirely above said wheel, wherein said first portion and said second portion are an elongated cubic rectangular member, wherein said steel body includes a top end and lateral sidewalls, wherein said first portion extends outwardly from one of said lateral sidewalls, said first portion angled upwardly from said lateral sidewalls, wherein said second portion is mounted thereon a top end of said first portion, wherein said second portion is angled downwardly with respect to the first portion, wherein said second portion further includes a chute head, wherein said chute head is mounted to a distal end of the second portion, wherein said first portion receives sand collected by said auger, said sand then travels up to said second portion and is then dispensed from said chute head, wherein said sand dispensed from said chute head is fed into a sand bag.

2. The system for filling bags with sand of claim 1 wherein said steel frame is made of a durable steel material.

3. The system for filling bags with sand of claim 1 wherein said wheels allow a user to maneuver said frame in a sand environment.

4. The system for filling bags with sand of claim 1 wherein said steel frame includes an LED headlight to allow a user to operate said system for filling sandbags during nighttime.

5. The system for filling bags with sand of claim 1 wherein said second portion is hingedly mounted to said first portion of said chute assembly.

6. The system for filling bags with sand of claim 1 wherein said chute head is hingedly mounted to said second portion of said chute assembly.

7. The system for filling bags with sand of claim 1 wherein said chute assembly dispenses sand collected by said auger into a sandbag.

8. The system for filling bags with sand of claim 1 wherein said chute assembly is adjustably maneuverable.

9. The system for filling bags with sand of claim 1 wherein said auger rotates as a user operates said system for filling bags with sand.

10. A sand collecting device, consisting of:

a motor assembly; including a steel frame and a platform, wherein said steel frame includes at least two wheels mounted to said steel frame, wherein said wheels are high traction tires, wherein a motor is mounted on top of said platform, wherein said motor is configured to rotate said wheels, wherein said frame includes a vertical portion, wherein said vertical portion includes user controls thereon, wherein said user controls are configured to provide a user with multiple drive speeds, and electric start, wherein said motor assembly includes a steel body mounted to the front end of said platform, wherein said steel body is located entirely in front of said wheels, wherein said vertical portion further includes an LED headlight configured to aid a user in nighttime operation;

an auger assembly, including an auger and a housing, wherein said housing is a cubic shaped hollow body having an open frontside and an open backside, wherein said backside has a larger area than said frontside, wherein said housing includes a top end, wherein the top end tapers from said backside to said frontside, wherein said backside is mounted onto the said steel body of said motor assembly, wherein said steel body includes a front face which abuttingly engages with said backside of housing, wherein a shape of said backside cooperates with a shape of said front face such that said backside entirely covers said front face, wherein said auger is mounted in a horizontal position therein sidewalls of said housing, wherein, wherein said housing is receives a sand pile therein, wherein said auger is configured to be controlled by said motor where a user may control different speeds of said auger using said user controls, said auger rotates as it receives sand; and a chute assembly, including a first portion and a second portion, wherein a proximal end of the chute assembly is entirely above said wheel, wherein said first portion and said second portion are an elongated cubic rectangular member, wherein said steel body includes a top end and lateral sidewalls, wherein said first portion extends outwardly from one of said lateral sidewalls, said first portion angled upwardly from said lateral sidewalls, wherein said second portion is hingedly mounted thereon a top end of said first portion, wherein said second portion is angled downwardly with respect to the first portion, wherein said second portion further includes a chute head hingedly mounted to a distal end of said second portion, wherein said first portion receives sand collected by said auger, said sand then travels up to said second portion and is then dispensed from said chute head, wherein said sand dispensed from said chute head is fed into a sand bag.

* * * * *